United States Patent [19]

Hicks

[11] Patent Number: 4,465,304

[45] Date of Patent: Aug. 14, 1984

[54] METHOD AND ARTICLE FOR PROTECTING SKIS

[76] Inventor: Lewis O. Hicks, 13851 Triadelphia Mill Rd., Clarksville, Md. 21029

[21] Appl. No.: 358,869

[22] Filed: Mar. 17, 1982

[51] Int. Cl.[3] ..... A63C 11/02

[52] U.S. Cl. ..... 280/814

[58] Field of Search ..... 280/814, 816, 815; 24/3 M, 3 E, 68 SK, 68 F, 68 BT, 298, 300, 301, 302, 204, DIG. 16, DIG. 17; 150/43; 206/315.1; 224/917

[56] References Cited

U.S. PATENT DOCUMENTS

| | | | |
|---|---|---|---|
| 2,118,875 | 5/1938 | Windheim | 24/302 |
| 2,180,686 | 11/1939 | Lorinovich | 280/815 |
| 2,469,604 | 5/1949 | Lynn | 280/815 |
| 3,175,838 | 3/1965 | Thomas | 280/815 |
| 3,731,348 | 5/1973 | Luehne | 280/814 |
| 3,808,646 | 5/1974 | Brumlik | 24/204 |
| 3,841,648 | 10/1974 | Meyer | 280/814 |
| 3,851,689 | 12/1974 | Kohla | 280/814 |
| 3,947,927 | 4/1976 | Rosenthal | 280/814 |
| 4,012,050 | 3/1977 | Miller | 280/809 |

FOREIGN PATENT DOCUMENTS

| | | | |
|---|---|---|---|
| 1089440 | 3/1955 | France | 24/302 |
| 2364004 | 4/1978 | France | 24/204 |
| 51058 | 11/1930 | Norway | 280/815 |
| 402697 | 5/1966 | Switzerland | 280/814 |

*Primary Examiner*—David M. Mitchell

*Attorney, Agent, or Firm*—Kerkam, Stowell, Kondracki & Clarke

[57] ABSTRACT

A ski protection method and article uses an elastic, resilient, elongate flat body portion having a number of straps extending out. The flat body portion may be placed in between the bottoms of two skis and the straps secure the body portion and the two skis together, thereby protecting the ski edges. Male and female straps are used for avoiding undue stress on a particular portion of a strap and for quick assembly/disassembly.

20 Claims, 5 Drawing Figures

METHOD AND ARTICLE FOR PROTECTING SKIS

BACKGROUND OF THE INVENTION

This invention relates to the protection of skis. More specifically, this invention relates to a method and article which may be used for protecting the edges and bottoms of skis during storage and transportation.

The prior art has used numerous different methods and articles for securing skis together for ease of transportation and protection of the skis. Often skis have been tied together by bands or straps of leather provided with metal buckles fastening opposite ends of the straps together. Alternately, relatively heavy rubber bands having mating metal clips at opposite ends have been used. Further, a number of bags or similar containers have been used for protecting the skis.

Prior U.S. patents include the following:

U.S. Pat. Nos., 2,180,686, Lorinovich, Nov. 21, 1939
U.S. Pat. Nos., 3,731,348, Luehne, May 8, 1973
U.S. Pat. Nos., 3,841,648, Meyer, Oct. 15, 1974
U.S. Pat. Nos., 3,851,689, Kohls, Dec. 3, 1974
U.S. Pat. Nos., 4,012,050, Miller, Mar. 15, 1977

The Lorinovich patent discloses a ski protector having two canvas covers which fit around separate skis of a pair and may be strapped together.

The Luehne patent discloses a ski tying strap using layers of elastic rubber which fit in between a pair of bottom-to-bottom skis and extend around the outside of the skis. Fabric fasteners such as sold under the brand "Velcro" are used for securing the strap to encircle the skis.

The Meyer patent shows a tie which may be used for securing skis together in a bottom-to-bottom relationship with a small layer of nylon reinforced polyvinyl material in between the ski bottoms. Fabrics fasteners such as "Velcro" are used to secure the tie.

The Kohls patent shows a ski cover wherein two skis may be positioned in bottom-to-bottom relationship with a partition of flexible material in between their bottoms.

The Miller patent shows a ski protector which will fit around a ski in a fashion similar to a boot fitting around a wearer's foot. Additionally, the bottom of the boot-like protection may include adhesive fabric strips, such as "Velcro", which may be used to mate one ski boot to a ski boot around the other ski of the pair.

Although prior art ski protectors have been generally useful in certain respects, they have been subject to a number of disadvantages. Although the tie or band type ski protectors are convenient because of their relatively small size, they are disadvantageous generally in that they do not protect the ski edges except at the points on the skis where they are located. That is, the ski edges may be damaged anywhere along the length of the ski except where the ties or bands are actually located. Further, several of the prior art ski protectors include metal parts which may mar ski edges or ski bottoms and may injure individuals, especially where they are used with elastic bands which may snap the metal part against an individual's skin. Although the bag type protector devices avoid several of these problems, they are disadvantageous in that they are not as easy to store as the tie or band protectors. Often they are too bulky to fit in a skier's pocket. Further, such bag type protectors and especially boot type protectors which fit over a ski are disadvantageous in that they may be limited to use with a particular size ski. If a boot is made for a particular size ski, it will not satisfactorily protect skis which are of a different size.

OBJECTS

Accordingly, it is a primary object of the present invention to provide a new and improved method and article for protecting and securing skis.

A further object of the present invention is to provide an article for protecting skis which is easy to store, as in a skier's pocket.

A further object of the present invention is to provide a method and article for protecting skis which may be easily and quickly secured to the skis.

Yet another object of the present invention is to provide a method and article for protecting skis which is applicable to all common sizes and shapes (thickness, width or camber) skis.

Another object of the present invention is to provide a method and article for protecting skis wherein the article may be easily manufactured at relatively low cost and can be made of one material.

A still further object of the present invention is to provide a method and article for protecting skis wherein the ski edges are protected substantially along the length of the skis.

SUMMARY OF THE INVENTION

The above and further objects of the present invention which will become apparent as the description proceeds are provided by a method of protecting and securing skis by use of an article having an elongate flat body portion and a plurality of straps, each strap narrower than the length of the flat body portion, the steps comprising: placing the flat body portion directly in between two bottom-to-bottom skis, the flat body portion extending lengthwise substantially along the length of the skis, and tightening each of the straps to secure the flat body portion and the the two skis together such that each strap extends at least partially around at least one of the two skis and each ski of the two skis has at least one strap partially around it. The flat body portion is made of resilient material such that the tightening step results in resilient cushioning of the bottoms of the skis. Further, the straps are made of resilient material such that the tightening step includes stretching of the straps. The straps and the flat body portion are integral such that the stretching of the straps also tends to stretch the body portion.

The article for protecting skis according to the present invention comprises an elongate flat body portion having two long edges, two short edges, and two flat faces; and a plurality of straps for securing the body portion to a pair of skis with the body portion in between the bottoms of the skis, the straps extending out from at least one of the long edges, each strap having a width less than the length of the flat body portion. The elongate body portion is made of resilient material for cushioning the bottoms of the two skis. The straps are made of resilient material and are integral with the body portion. The straps include pairs of corresponding male and female straps such that each pair of corresponding male and female straps together with the body portion are adapted to encircle at least one of the skis in the pair.

BRIEF DESCRIPTION OF THE DRAWINGS

The above and other features of the present invention will be more easily understood when taken in conjunction with the accompanying drawings wherein like reference characters represent like parts throughout and in which.

DETAILED DESCRIPTION OF THE INVENTION

Figure 1:
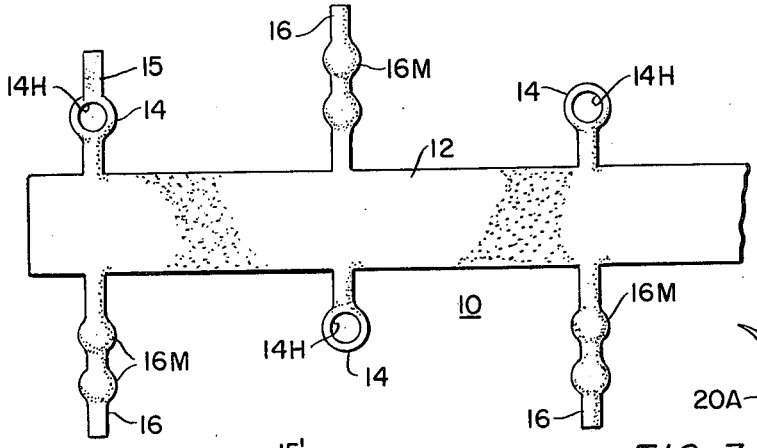
FIG. 1 shows a top view of the present invention.

Turning now to FIG. 1, the basic construction of the present invention will be discussed. The ski protecting article 10 according to the present invention includes an elongate flat body portion 12 having two long edges, two short edges, and two flat faces. The plane of the view of FIG. 1 is taken parallel to one of the flat faces and one end of the elongate body portion is broken away for ease of illustration, it being readily understood that the article 10 may extend further to the right from the break-away line of FIG. 1. Extending out from the elongate flat body portion 12 are a number of female straps 14 and corresponding male straps 16. The straps are spaced along the length of body portion 12. The straps 14 and 16 extend out from the two long edges of body portion 12 as shown. Each female strap 14 may include a generally circular hole 14H which is used to accomodate one of the two spherical portions 16M on the corresponding male strap 16. If desired, all or some of female straps 14 may include an extension 15 (shown only for far left female straps 14 in FIG. 1) to ease the manipulation of straps 14 to allow insertion of spherical portions 16.

Figure 2:
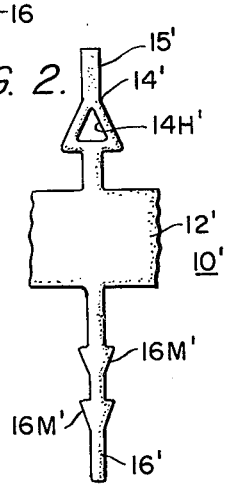
FIG. 2 shows a top view of an alternate embodiment of the present invention.

Turning momentarily to FIG. 2, an alternate embodiment may use a female strap 14' having a triangular hole 14H' and a male strap 16' having tapered portions 16M' for mating with the hole 14H'. An extension 15' may be used at the end of strap 14'. The holes 14H and portion 16M function as securing means, as do the holes 14H' and portions 16M'.

As shown in the views of FIG. 1 and FIG. 2, the article 10 or 10' according to the present invention is disposed in its natural flat position. The article is of unitary or integral construction and is made of rubber molded as a unit. Except for the spherical portions 16M on the embodiment of FIG. 1, either of the articles 10 or 10' may be disposed in a completely flat or planar condition. The article 10 or 10' may be easily rolled up from its flat position to form a roll which may easily fit in a skier's pocket or otherwise be stored in a small space. As shown, each of the straps 15 and 16 is integral with an oppositely extending strap 16 and 15 respectively.

OPERATION

Figure 3:
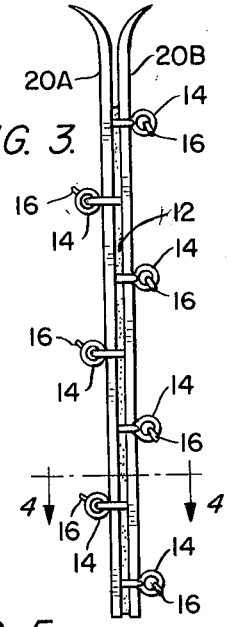
FIG. 3 shows the article of the present invention secured for protecting two skis.
Figure 4:
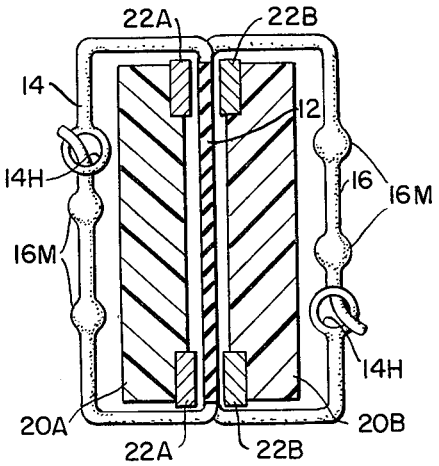
FIG. 4 shows a cross-section view taken along lines 4—4 of FIG. 3 and before the straps of the present invention are tightened.
Figure 5:
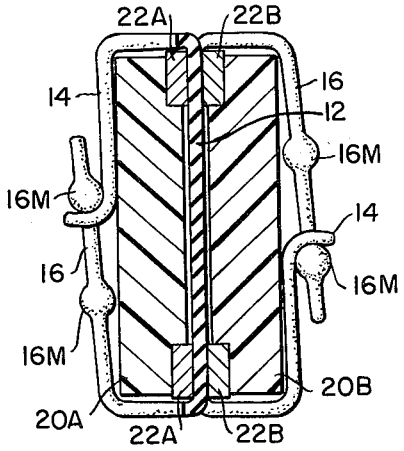
FIG. 5 shows a cross-section view from the same plane as FIG. 4 and with the straps tightened.

The operation of the present invention will now be discussed with reference to FIGS. 3, 4, and 5. FIG. 3 shows a side view lengthwise of two skis with the present invention secured thereto. FIG. 4 shows a cross-section view taken along lines 4—4 of FIG. 3 prior to the tightening of the straps, whereas FIG. 5 shows the same view after the straps have been tightened. As shown, the body portion 12 has a solid (i.e., not hollow) cross-section.

The article may be used to protect the skis by first placing the flat body portion 12 directly in between two bottom-to-bottom skis 20A and 20B, the flat body portion extending lengthwise substantially along the length of the skis. Next, each of the straps 14 and 16 may be tightened to secure the body portion 12 (or 12') and the two skis together such that each strap extends at least partially around at least one of the two skis and each ski has at least one strap partially around it. As shown in FIG. 3, the straps may be alternated with the upper corresponding pair around ski 20B and the next corresponding pair of straps around ski 20A and likewise alternated down the length of the skis.

In order to tighten the straps, the end of male strap 16 is pulled such that one of the spherical portions 16M expands the hole 14H of strap 14 sufficiently for spherical portion 16M to be pulled therethrough. Once the spherical portion 16M is pulled through the hole 14H to be in the position of FIG. 5, the hole 14H will contract sufficiently to prevent spherical portion 16M from moving through the hole in the absence of a person pulling on the other end of strap 16. That is, the spherical portion 16M will hold the male strap 16 and female strap 14 together until someone pulls the male strap out of the female strap which will expand the hole 14H in the female strap 14. As shown, each of male straps may include two spherical portions 16M in order to accomodate different sizes and thicknesses of skis. More than two spherical portions could of course also be used.

By using male and female straps, the present article avoids placing undue stress on a particular part of the straps by facilitating the equalization of elastic stress around the straps.

It is highly preferred to make the body portion integral with the straps 14 and 16 by molding them out of rubber together. This not only holds down the manufacturing costs, but also causes the tightening step to resiliently cushion the bottoms of the skis 20A and 20B. Further, this results in the tightening of the straps causing the straps to stretch, thereby tending to also stretch the body portion.

If the alternate form of the straps shown in FIG. 2 is used, it will be readily appreciated that the tapered portion 16M' may simply slip through the bottom (as shown in FIG. 2) of the hole 14H', but will not slip out of the hole 14H' without manual manipulation because the step on the back of the tapered portion 16M' will catch on the right and left sides of the triangular hole 14H'.

An alternate embodiment would use straps which are longer than those shown such that each female strap 14 would extend around both skis in the pair. Likewise, each male strap 16 would extend around both skis in the pair and fasten to the female strap 14 at its end. This is advantageous in that the straps 14 and 16 could all be fastened together on one side of the pair of skis.

Quite importantly, the article 10 (or 10') according to the present invention will protect the ski edges 22A and 22B substantially all along the length of the skis 20A and 20B. Indeed, it is preferred that the ski protection article 10 or 10' extend lengthwise co-extensively with the metallic ski edges 22A and 22B or at least over 80 percent of this length. As clearly shown in FIG. 3, the article causes the skis to be parallel substantially completely along the length of the ski edges. The present invention could also be used for cross-country skis which often lack metallic ski edges.

The short edges or width of the elongate body portion 12 may simply be the same size or slightly wider than the widest ski. The article 10 or 10' may easily be used with narrower skis in which case the elongate body portion will simply extend slightly along the side of the ski in the same direction as the nearest strap.

The article 10 or 10' will easily accomodate skis having different cambers. The camber, which is the curve or bow in the ski and varies significantly among ski styles, may be easily acommodated by the resilience and stretching of the rubber used for the body portion 12 and straps 14 and 16. The article 10 or 10' may be made in one long size and adapted for use with shorter skis by simply cutting the rubber body 12.

Note that the ski bindings (not shown) may easily fit between adjacent straps without any special provisions being necessary. Alternately, straps which might be in way of bindings could be easily cut off.

Although various specifics have been disclosed herein, it is to be understood that these are for illustrative purposes only. Various modifications and adaptations will be readily apparent to those of ordinary skill in the art. Accordingly, the scope of the present invention should be determined by reference to the appended claims.

What is claimed is:

1. A method of protecting and securing skis by use of an article having an elongate flat body portion and a plurality of straps, said flat body portion being made of a solid cross-section of resilient material, said flat body portion having parallel oppositely facing surfaces, each strap including securing means, each strap narrower than the length of the flat body portion, the steps comprising:

(a) placing said flat body portion directly in between two bottom-to-bottom skis, each flat body portion extending lengthwise substantially completely along the length of the skis with each of said surfaces in contact with the bottom of one of the skis, and (b) tightening each of said straps using said securing means to secure each of said straps to another of said straps such that said flat body portion and said two skis are together with said solid cross-section of resilient material extending lengthwise substantially completely along the length of the skis, each strap extending at least partially around at least one of said two skis and each ski of said two skis has at least one strap partially around it, and wherein said article is rollable along said flat body portion for easy storage.

2. The method of claim 1 wherein the ski bottoms are held parallel by the article along at least 80% of the length of metallic ski edges on this skis.

3. The method of claim 1 wherein said straps are made of resilient material such that the tightening step includes stretching of the straps.

4. The method of claim 3 wherein said straps and said flat body portion are integral such that said stretching of the straps also tends to stretch said body portion.

5. The method of claim 4 wherein said straps include both male straps and female straps, and the tightening step is accomplished by fitting each male strap into a corresponding female strap such that each male strap and corresponding female strap together with said body portion encircle at least one of said two skis.

6. The method of claim 5 wherein each of said male straps includes a spherical portion and each of said female straps includes a receiving hole and the tightening step is accomplished by inserting each spherical portion into and through a corresponding receiving hole.

7. The method of claim 1 wherein said straps extend out beyond opposite sides of said flat body portion.

8. The method of claim 7 wherein each strap is flat and extends around only a single one of said skis.

9. The method of claim 1 wherein said resilient material of said flat body portion is rubber.

10. The method of claim 1 wherein said flat body portion extends at least along 80% of the length of metallic ski edges on the skis.

11. The method of claim 1 wherein each of said straps is integral with an oppositely extending strap.

12. An article for protecting skis comprising:

(a) an elongate flat body portion being made of a solid cross-section of resilient material, having two long edges, two short edges, and two parallel oppositely facing flat surfaces; and (b) a plurality of straps for securing said body portion to a pair of skis with said body portion in between the bottoms of the skis and each of said flat surfaces in contact with the bottom of one of the skis substantially completely along the length of the skis, said straps extending out from both of said long edges, each strap having a width less than the length of said flat body portion, and each strap including a securing means to secure it to another of said straps, and wherein said article is rollable along said flat body portion for easy storage.

13. The article of claim 12 wherein said straps and said body portion are integral.

14. The article of claim 13 wherein said straps include pairs of corresponding male and female straps such that each pair of corresponding male and female straps together with said body portion are adapted to encircle at least one of the two skis.

15. The article of claim 14 wherein each of said male straps includes a spherical portion and each of said female straps includes a receiving hole and said straps are adapted to secure said body portion to a pair of skis by inserting a spherical portion into a corresponding receiving hole.

16. The article of claim 12 wherein said straps extend out from both of said long edges.

17. The article of claim 16 wherein each of said straps includes securing means.

18. The article of claim 12 wherein said resilient material of said flat body portion is rubber.

19. The article of claim 12 wherein said flat body portion is operable to cushion and extend between at least 80% of the length of metallic ski edges on the skis.

20. The article of claim 12 wherein each of said straps is integral with an oppositely extending strap.

* * * * *